United States Patent [19]

Young

[11] Patent Number: 4,489,932

[45] Date of Patent: Dec. 25, 1984

[54] AMUSEMENT DEVICE

[76] Inventor: Gary L. Young, 3405 Sinton Rd. #199, Colorado Springs, Colo. 80907

[21] Appl. No.: 435,944

[22] Filed: Oct. 22, 1982

[51] Int. Cl.[3] ..... A63G 1/12

[52] U.S. Cl. ..... 272/36

[58] Field of Search ..... 272/28 R, 1 B, 1 R, 272/32, 33 R, 33 A, 33 B, 34, 35, 36, 114, 115; 434/34, 57, 136, 139, 140; 280/78, 206, 207, 208, 28.5; 180/21; 441/78; 74/471 XY; 119/29; D19/63; 104/68, 77, 78

[56] References Cited

U.S. PATENT DOCUMENTS

| | | | |
|---|---|---|---|
| 1,029,904 | 6/1912 | Allegretti | 272/1 B |
| 2,344,454 | 3/1944 | Poltner | 272/1 B X |
| 2,528,516 | 11/1950 | Herrmann | 272/1 R |
| 2,957,252 | 10/1960 | Pain | 434/136 |
| 3,013,806 | 12/1961 | Boyd | 272/1 R X |
| 3,066,951 | 12/1962 | Gray | 272/115 X |
| 3,083,979 | 4/1963 | Boyd | 272/115 X |
| 3,119,612 | 1/1964 | Whitson | 272/33 R |
| 3,135,057 | 6/1964 | Nelson et al. | 272/36 X |
| 3,269,190 | 8/1966 | Laman | 74/471 XY |
| 4,272,093 | 6/1981 | Filice et al. | 280/206 |

*Primary Examiner*—Robert A. Hafer
*Assistant Examiner*—Arnold W. Kramer
*Attorney, Agent, or Firm*—Richard W. Hanes

[57] ABSTRACT

An amusement device is disclosed which comprises a generally spherically shaped hollow shell structure having an interior sufficiently large to accomodate a human being and including an opening with a removable hatch cover to permit a human being to enter the shell structure. The shell structure is supported in a support frame on casters so that the shell structure can be rocked or rotated in any direction when the user shifts his weight within the shell structure.

5 Claims, 13 Drawing Figures

FIG. 1.
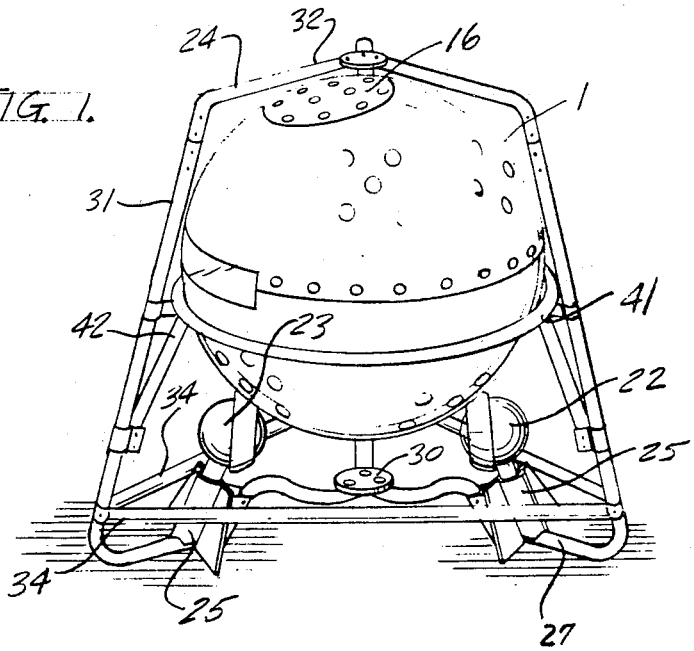
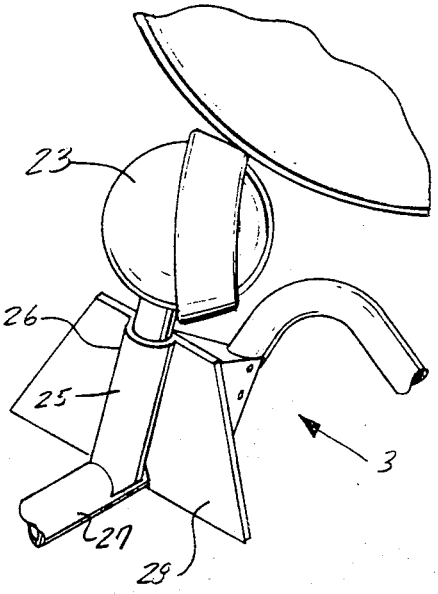
FIG. 2.
FIG. 3.
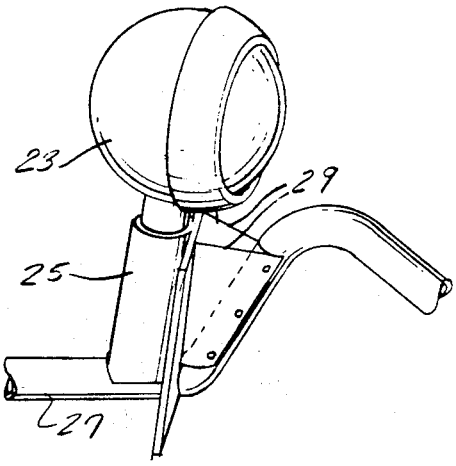

AMUSEMENT DEVICE

BACKGROUND AND SUMMARY OF THE INVENTION

The present invention relates to an amusement device within which an occupant, such as a child, may rotate by shifting his weight so as to put the device into motion and to control the direction of the motion.

Amusement devices of the aforementioned type have been known for many years. For example, in U.S. Pat. No. 1,521,133 a ring-shaped device is disclosed which is preferably started on a slight incline so as to give it sufficient momentum to continue tumbling on down a hill with a youngster firmly seated therein. The motion of a child in this device is limited to somersault motion as the device rolls down the hill. This known device is also disadvantageous in that it requires a relatively large amount of space for use, hence is normally for outdoor use only, and it poses considerable risk of injury to the user from shock during the wheeling motion and also from impact when the rolling device is brought to an abrupt halt.

Spherical amusement devices for accommodating an occupant have also been proposed as in U.S. Pat. Nos. 3,066,951; 3,806,156 and 4,042,252, for example. In these devices the user may enjoy the sensation of rolling end over end, sideways or otherwise. In the device disclosed in U.S. Pat. No. 3,066,951, the spherical shell is made of aluminum. To reduce injury and help absorb shock the interior of the aluminum shell is covered with a resilant shock absorbing material such as foam rubber.

The devices in U.S. Pat. Nos. 3,806,156 and 4,042,252 are inflatable spherical devices wherein the space between two spherical shells is inflated with air. The shock absorbent qualities of the inflated structure to protect the occupant from injury on impact when the rolling device is brought to an abrupt halt. While such known spherical amusement devices are safer than the metal ring-shaped type of device referred to above, these known inflatable spherical devices are nevertheless disadvantageous in that they are more complexed and expensive to manufacture, are relatively bulky and inconvenient to use requiring large amounts of space for use — hence normally are for outdoor use only, and do not entirely eliminate the risk of injury to the occupant.

One recent attempt to avoid at least some of the aforementioned problems associated with these known spherical amusement devices is disclosed in U.S. Pat. No. 4,272,093, wherein it is proposed to limit the travel of the generally spherical shell or housing of the amusement device by means of a ring having a curved wall which is placed about the spherical shell. The spherical shell can be rolled up on the curved wall portion of the ring, permitting the shell to roll back toward the other parts of the curved wall portion. Spikes are used to secure the ring to the ground outdoors. Weights may be substitured for spikes if the device is to be used indoors. However, this known device is relatively bulky and inconvenient for indoor use because of the size of the ring and the weights needed to support it. The motion of the user in such a device is also relatively limited because the rolling or rotational movement of the shell is constantly stopped and redirected by the surrounding ring.

An object of the present invention is to provide an improved amusement device of the type described which avoids the aforementioned disadvantages associated with the known devices. More particularly, an object of the present invention is to provide an amusement device which permits the user to enjoy the sensation of rolling end over end, sideways or otherwise, without danger of injury, and which is relatively economical to construct, compact and easy to use, and can be used indoors or outdoors.

These and other objects of the present invention are attained by providing an amusement device comprising a generally spherically shaped hollow shell structure having an interior sufficiently large to accommodate a human being and including means permitting a human being to enter said shell structure, and means for supporting said shell structure for rotation in any direction.

According to a disclosed, preferred embodiment of the invention the means permitting a human being to enter the shell structure includes a hatch opening in the shell structure and a hatch cover for closing the opening. The means for supporting the shell structure for rotation in any direction includes a plurality of casters upon which the shell structure is supported. The casters are connected to a support frame of the device which surrounds the shell structure. A safety ring is provided in close spaced relationship about the shell structure to support the shell structure in the event one of the casters enters the hatch opening when the hatch cover is removed. The safety ring is connected to the support frame of the device.

While rocking or rotational movement of the device may be effected by the user shifting his weight, according to an additional feature of the invention a drive motor means is provided for rotating the shell structure. The drive motor means includes a multi-directional friction drive wheel which engages the outer surface of the shell structure. Means are provided for remotely controlling the drive motor means from within the shell structure.

As a further feature of the invention a stop is provided for selectively preventing rotation of the shell structure. The stop includes a rod which is connected to the support frame of the device for movement between a retracted position and an extended position. An opening is provided in the shell structure for receiving the end of the rod when the rod is in the extended position thereby preventing rotation of the shell structure so that a user may safely enter and leave the spherical shell structure.

These and other objects, features and advantages of the present invention will become more apparent from the following description when taken in connection with the accompanying drawings which show, for purposes of illustration only, one embodiment in accordance with the present invention.

BRIEF DESCRIPTION OF THE DRAWINGS

FIG. 1 is a an elevational view from the side of an amusement device according to the invention;

FIG. 2 is a side view, partially cut away of a caster for supporting the spherically shaped hollow shell structure of the invention;

FIG. 3 is an elevational view, partially cut away, taken in the direction of arrow 3 in FIG. 2 and illustrating the connection between the caster and the support frame of the device;

DESCRIPTION OF THE DISCLOSED EMBODIMENT

Figure 7:
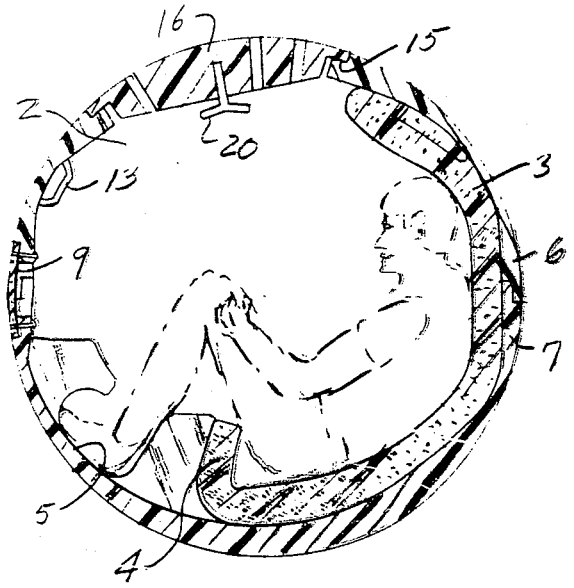
FIG. 7 is a cross-sectional view of the spherically shaped hollow shell structure taken along the line 7—7 in FIG. 4.

Referring now to the drawings, the amusement device of the invention comprises a generally spherically shaped hollow shell structure 1 having an interior 2 sufficiently large to accommodate a human being such as a child as shown in outline in FIG. 7. The spherical shell structure 1 is formed of a plastic material such as ABS, polyvinglchloride, polyethylene, acrylic polystyrine or polypropylene having a substantially hard and wear resistant outer surface. The shell structure is provided with a substantially thick, soft and resiliant rubber or foam lining material 3 over most of its internal surface so as to form a seat 4 for the occupant with an area 5 being provided for the feet of the occupant.

Figure 8:
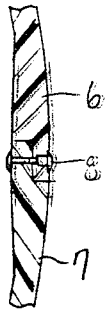
FIG. 8 is a partial cross-sectional view of the spherically shaped hollow shell structure of the invention at the joint of the two hemispheres thereof.
Figure 9:
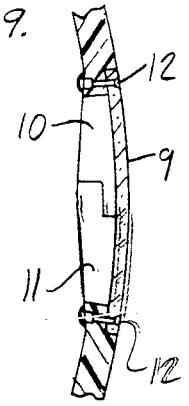
FIG. 9 is a cross-sectional view of the spherically shaped hollow shell structure taken along the line 9—9 of FIG. 4 and illustrating a joint at the point of a window in the capsule.

The shell structure 1 is split into two hemi-spherical portions 6 and 7 which are joined at their thickened edges by a cooperating tongue and groove arrangement and suitable fasteners 8 as shown in FIG. 8. A window 9 is provided in the spherical shell structure 1 in the area of the joint between the hemi-spherical portions 6 and 7 opposite the occupant's seat 4. The window 9 is formed of transparent plastic material which is placed over opposed cutouts or recesses 10 and 11 in the respective hemi-spherical portions 6 and 7. Fasteners 12 are used to connect the window to the respective portions so that the window follows the contour of the spherical shell structure in the manner illustrated in FIG. 9. A plurality of handles 13 are also secured to the interior surface of the spherical shell structure 1. One such handle is illustrated in FIG. 7 of the drawings. The handles enable an occupant to firmly grip the shell structure from inside, and to impart rocking, rolling, tilting or pivoting movement to the spherical structure by throwing his weight from side to side while holding the handles.

Figure 4:
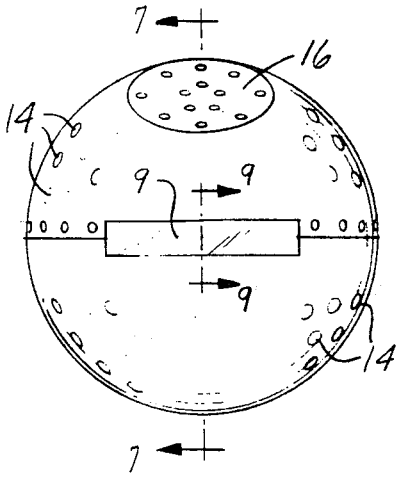
FIG. 4 is a front elevational view of the sherical shaped hollow shell structure of the invention.
Figure 5:
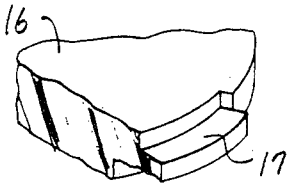
FIG. 5 is a perspective view of the hatch cover, partially cut away, for the spherically shaped hollow shell structure of the invention.
Figure 6:
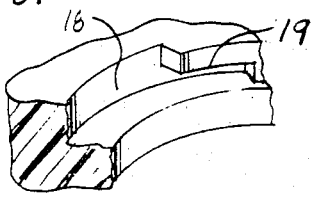
FIG. 6 is a cross-sectional view of the spherically shaped hollow shell structure around the hatch opening with the hatch cover removed.

A plurality of holes such as those shown at 14 in FIG. 4 are provided through the spherical shell structure 1 and lining 3 therein about the surface of the shell structure to provide adequate ventilation. A single, relatively large opening 15 is also formed in the upper portion of the hemi-spherical portion 6 to permit a human being to enter and exit from the shell structure. The opening 15 is normally closed during use by a removable hatch cover 16. The hatch cover is secured in the opening 15 by a cooperating tongue and groove arrangement shown in FIGS. 5 and 6. To close the opening 15 the hatch cover 16 is placed in the opening and rotated slightly so that the tongue or projection 17 thereon moves in the groove 18 in the surrounding shell structure to a position beneath the ledge 19 where the hatch cover is securely held in position. A knob 20 on the inside of the hatch cover 16 permits the hatch cover to be easily rotated from inside the shell structure for securing or removing the hatch cover. The hatch cover also can be easily removed from its secured position from the outside of the shell structure by placing ones fingers in the holes 14 therein and rotating the cover to the release position.

The spherical shell structure 1 is supported for rotation in any direction on three Shepherd casters 21, 22 and 23. The casters are connected to a support frame 24 of the device by brackets 25 which include an inclined, upstanding cylindrical member 26 which is mounted on a leg 27 of the support frame, a support plate 28 connected to the cylindrical member 25 and connecting flanges 29 extending between the support plate and the tubular leg 27 and being connected thereto by welding, for example. The support plate 28 extends laterally with respect to the tubular leg 27 and at a level with the lower surface thereof to provide additional stability to the support frame.

Figure 11:
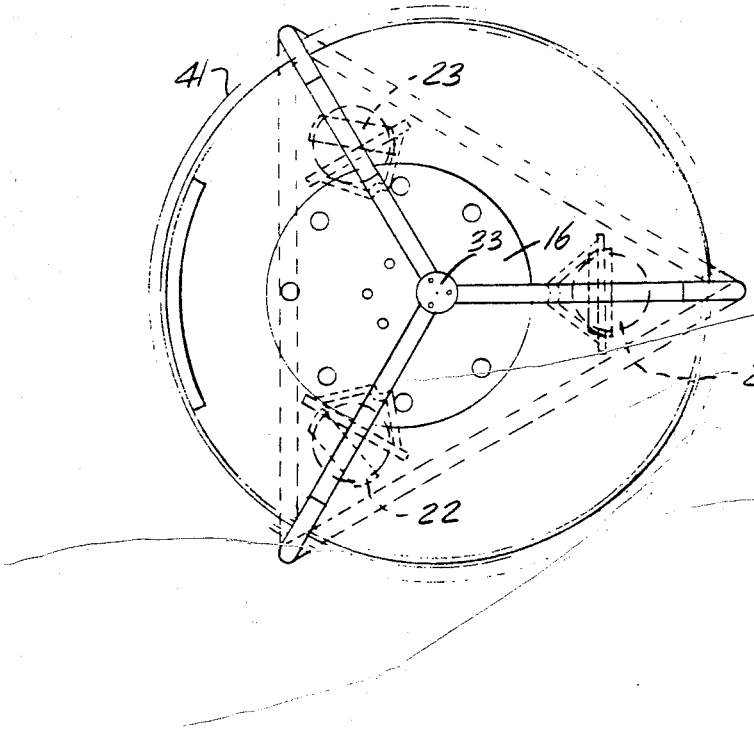
FIG. 11 is a top view of the amusement device of the invention.

The support frame 24 includes a base portion formed of three outwardly extending tubular legs 27 which are connected at their inner ends beneath the shell structure 1 by means of a connecting plate 30. The outer ends of the legs 27 are curved upwardly into inclined, upstanding tubular leg portions 31. The tubular leg portions 31 extend to a height above the shell structure 1 where they are bent over to form essentially horizontally extending tubular leg portions 32 whose inner ends are connected to one another by means of a connecting plate 33 shown in FIG. 11. Thus, the support frame 24 actually surrounds the shell structure 1. Struts 34 extend between the respective tubular leg portions 31 at the lower ends thereof to provide additional rigidity to the support frame. The struts 34, connecting plates 30 and 33, connecting flanges 29, support plates 28 and the various tubular leg portions of the support frame are formed of steel in the enclosed embodiment but may be other materials which provide the necessary strength and rigidity to support the shell structure 1 and the occupant during rotation. The tubular legs 27 and leg portions 31 and 32 of the support frame may be separate tubular members which are connected at their adjacent ends or each leg may be integral with its respective leg portions 31 and 32, that is, formed by bending a single steel tube.

Figure 10:
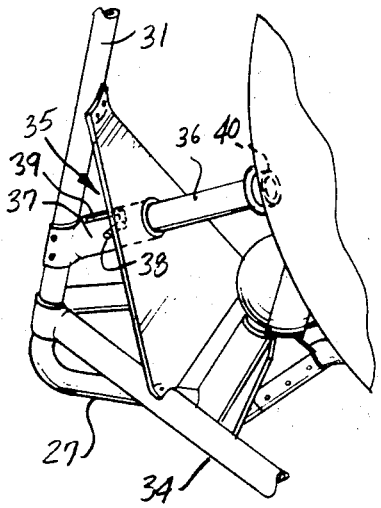
FIG. 10 is an elevational view of a portion of the device of the invention illustrating a stopping mechanism for stopping the rotational movement of the spherically shaped hollow shell structure.

One safety feature of the amusement device of the invention is the provision of a stop mechanism 35, see FIG. 10, which permits the position of the spherical shell structure to be fixed such as during entry and exit from the shell structure. The stop mechanism 35 comprises a rod 36 which is telescopingly received in one end of a cylindrical tubular member 37. The other end of the member 37 is fastened to a tubular leg portion 31 of the support frame. A pin 38 connected to the rod 36 is received in a groove 39 in the tubular member 37 to permit moving the rod 36 between a retracted position and an extended position. An opening 40 is provided in the shell structure 1 for receiving the outer end of the rod 36 when the rod is in the extended position thereby preventing rotation of the shell structure.

An additional safety feature of the present invention involves the provision of a safety ring 41. The ring encircles the spherical shell structure 1 in close spaced relationship thereto at a point beneath and inwardly from the widest diameter or mid portion of the shell structure. The ring 41 is connected to the tubular leg portions 31 of the support frame by means of support brackets 42. The support ring is positioned so that it will support the shell structure 1 in the event that the shell structure drops slightly as a result of a caster failure or a caster entering the opening 15 when the hatch cover is removed.

Figure 12:
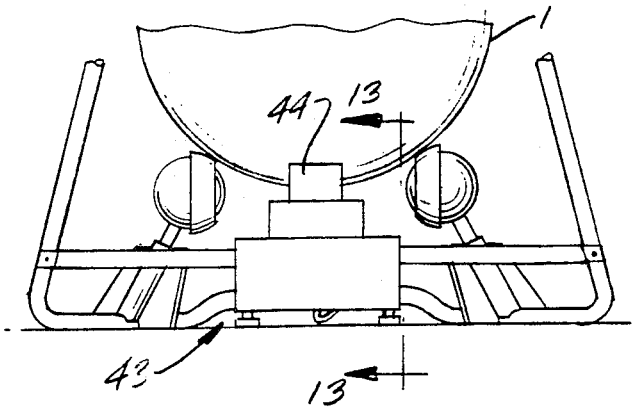
FIG. 12 is a side view, partially cut away, of the amusement device of the invention schematically illustrating a motorized remote-control multi-directional friction drive wheel for the shell structure.
Figure 13:
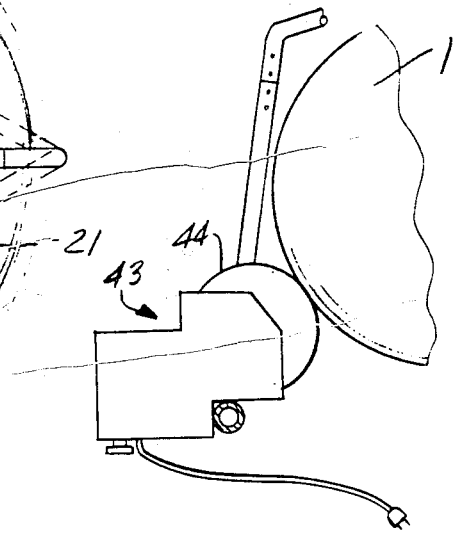
FIG. 13 is a cross-sectional view taken along the line 13—13 of FIG. 12 and further illustrating the motorized remote-control multi-directional friction drive wheel of the invention.

A further, optional feature which may be provided on the amusement device of the invention is a drive motor means for rotating the shell structure. Such a drive motor means is shown schematically at 43 in FIGS. 12 and 13. The drive motor means includes a friction drive wheel 44 which engages the outer surface of the shell structure 1 for driving the same. The friction drive wheel is driven by means of an electric motor which can be remotely controlled by a suitable control, not shown, from within the shell structure. Preferably, the friction drive wheel can be disengaged from driving contact with the shell structure so that, if desired, the occupant can rock or rotate the shell structure to carry out a number of random movements by simply changing his position.

While I have shown and described only one embodiment in accordance with the invention, it is understood that the same is not limited thereto but is susceptible of numerous changes and modifications as known to those skilled in the art. For example, the disclosed device of the invention is basically a plaything for children and its size is adjusted accordingly, however, larger spherical shell structures for use by adults are also understood to fall within the scope of this invention. Further, it is envisioned that a large number of attachments which might enhance the appearance of the apparatus and provide additional child appeal could be included as part of the device. I therefore do not wish to be limited to the details shown and described herein but intend to cover all such changes and modifications as are encompassed by the scope of the appended claims.

I claim:

1. An amusement device comprising:

a generally spherically shaped hollow shell structure having an interior sufficiently large to accommodate a human being including hatch means to permit ingress and egress from the interior of the shell structure;

a frame having an equilateral triangular ground plan base with upstanding leg portions from the apex of each base angle which converge to a common connection over the shell structure;

inverted castor means carried by the base frame at each of the three apexes thereof which castor means rotatably support the said shell structure for free rotation about the three mutually perpendicular axes of the shell.

2. An amusement device according to claim 1, wherein a stop means is provided for selectively preventing rotation of said shell structure, said stop means including a rod which is connected to one of said leg portions for movement between a retracted position and an extended position and an opening in said shell structure for receiving said rod when the rod is in said extended position thereby preventing rotation of said shell structure.

3. An amusement device according to claim 1, wherein a safety ring connected to said leg portions is provided in close spaced relationship about said shell structure at a point beneath and inwardly from the widest diameter or midportion of said shell structure to support said shell structure in the event it drops slightly from its normal supported position such as when said support means breaks.

4. An amusement device according to claim 1, wherein a drive motor means is provided for rotating said shell structure.

5. An amusement device according to claim 4, wherein said drive motor means includes a multi-directional friction drive wheel which engages the outer surface of said shell structure.

* * * * *